US006875065B2

(12) United States Patent
Tsuchiya et al.

(10) Patent No.: US 6,875,065 B2
(45) Date of Patent: Apr. 5, 2005

(54) TRIM OPERATING LEVER DEVICE FOR PERSONAL WATERCRAFT

(75) Inventors: Masahiko Tsuchiya, Wako (JP); Tomohiro Fuse, Wako (JP); Takao Kochi, Wako (JP); Hiroshi Iwakami, Wako (JP); Jun Nakajima, Wako (JP)

(73) Assignee: Honda Giken Kogyo Kabushiki Kaishi, Tokyo (JP)

( * ) Notice: Subject to any disclaimer, the term of this patent is extended or adjusted under 35 U.S.C. 154(b) by 0 days.

(21) Appl. No.: 10/660,210

(22) Filed: Sep. 10, 2003

(65) Prior Publication Data

US 2004/0116006 A1 Jun. 17, 2004

(30) Foreign Application Priority Data

Sep. 11, 2002 (JP) ..... 2002-265481

(51) Int. Cl.[7] ..... B63H 11/113
(52) U.S. Cl. ..... 440/42; 114/285
(58) Field of Search ..... 114/144 R, 285; 440/38, 42

(56) References Cited

U.S. PATENT DOCUMENTS 3,705,519 A * 12/1972 Sjoo ..... 74/471 XY
5,474,007 A * 12/1995 Kobayashi ..... 440/42
5,724,907 A * 3/1998 Castellucci ..... 114/144 R
5,855,182 A * 1/1999 Kline et al. ..... 116/28.1
6,085,684 A * 7/2000 Cotton ..... 114/285

FOREIGN PATENT DOCUMENTS

JP 9-281132 10/1997

* cited by examiner

*Primary Examiner*—Stephen Avila
(74) *Attorney, Agent, or Firm*—Merchant & Gould P.C.

(57) ABSTRACT

A trim operating lever device is disclosed which can downwardly or vertically swing a nozzle capable of adjusting the jet direction of jet water. When the trim operating lever is gripped with a finger of the hand which is gripping the steering handle, a lever of the lever lock means can be substantially simultaneously operated with the finger, to effect locking. Therefore, the number of operations by the left hand necessary for swinging the nozzle is reduced. Also, because the trim operating lever makes it possible to enlarge the operating force, the nozzle can be swung quickly.

7 Claims, 9 Drawing Sheets

TRIM OPERATING LEVER DEVICE FOR PERSONAL WATERCRAFT

FIELD OF THE INVENTION

The present invention relates to a trim operating lever device for a personal watercraft.

BACKGROUND OF THE INVENTION

In the conventional trim operating lever device, a handle grip attached to a left portion of a steering handle is turned by hand (see, for example, Japanese Patent Laid-open No. Hei 9-281132 (JP 9-281132) (p.5; FIG. 16)).

FIG. 9 is an illustration of a conventional left-side grip portion (a copy from FIG. 16 of JP 9-281132).

The conventional left-side grip 8*b* is for vertically oscillating a nozzle deflector provided at a jet port (for obtaining a trim angle) by being turned to a predetermined angle position, and comprises a trigger lever 91 for locking the left-side grip 8*b* in the predetermined angle position. With the left-side grip 8*b* turned to the predetermined angle position, the trim angle of the nozzle deflector can be set to any one of a neutral position (horizontal), an up position (upwards) and a down position (downwards). In the turning operation, first, the trigger lever 91 is pulled in, the left-side grip 8*b* is turned to the predetermined angle position, and the trigger lever 91 is released, upon which the left-side grip 8*b* is locked.

In the conventional left-side grip 8*b* as above-mentioned, it takes labor for the action of hand at the time of turning thereof. Specifically, first, the trigger lever 91 is pulled by an index finger (first action), subsequently the left-side grip 8*b* is turned to the predetermined angle position (second action), and finally the index finger is released from the trigger lever 91 (third action). Thus, three operations are necessary, which takes labor, and results in poor operability.

In addition, in the turning of the left-side grip 8*b*, it is difficult to enlarge the operating force, so that it is difficult to vertically oscillate (rotate) the nozzle deflector quickly.

Therefore, a need exists for a trim operating lever device for a personal watercraft that reduces the number of operations by the left hand that are necessary for swinging a nozzle and that allows the nozzle to be swung quickly.

SUMMARY OF THE INVENTION

In one embodiment, a personal watercraft is provided comprising a jet propeller for ejecting jet water, a nozzle capable of adjusting the jet direction of the jet water, the nozzle being arranged for the jet propeller, and a trim operating lever provided additionally to a steering handle. The nozzle being vertically swingable (rotatable) from a first ordinary direction when the trim operating lever is gripped, and the nozzle returning to the first ordinary direction when the grip on the trim operating lever is released, a lever lock means capable of locking the trim operating lever in a particular grip position is provided additionally to the steering handle.

When the trim operating lever is gripped by a finger of the left hand which is gripping the steering handle, a lever of the lever lock means can be substantially simultaneously operated by the finger, to effect locking. Therefore, the number of operations by the left hand necessary for swinging the nozzle is only two.

Furthermore, the trim operating lever makes it possible to enlarge the operating force, so that the nozzle can be swung quickly.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

An embodiment of the present invention will be described below based on the accompanying drawings. The drawings are to be looked at according to the posture of symbols.

Figure 1:
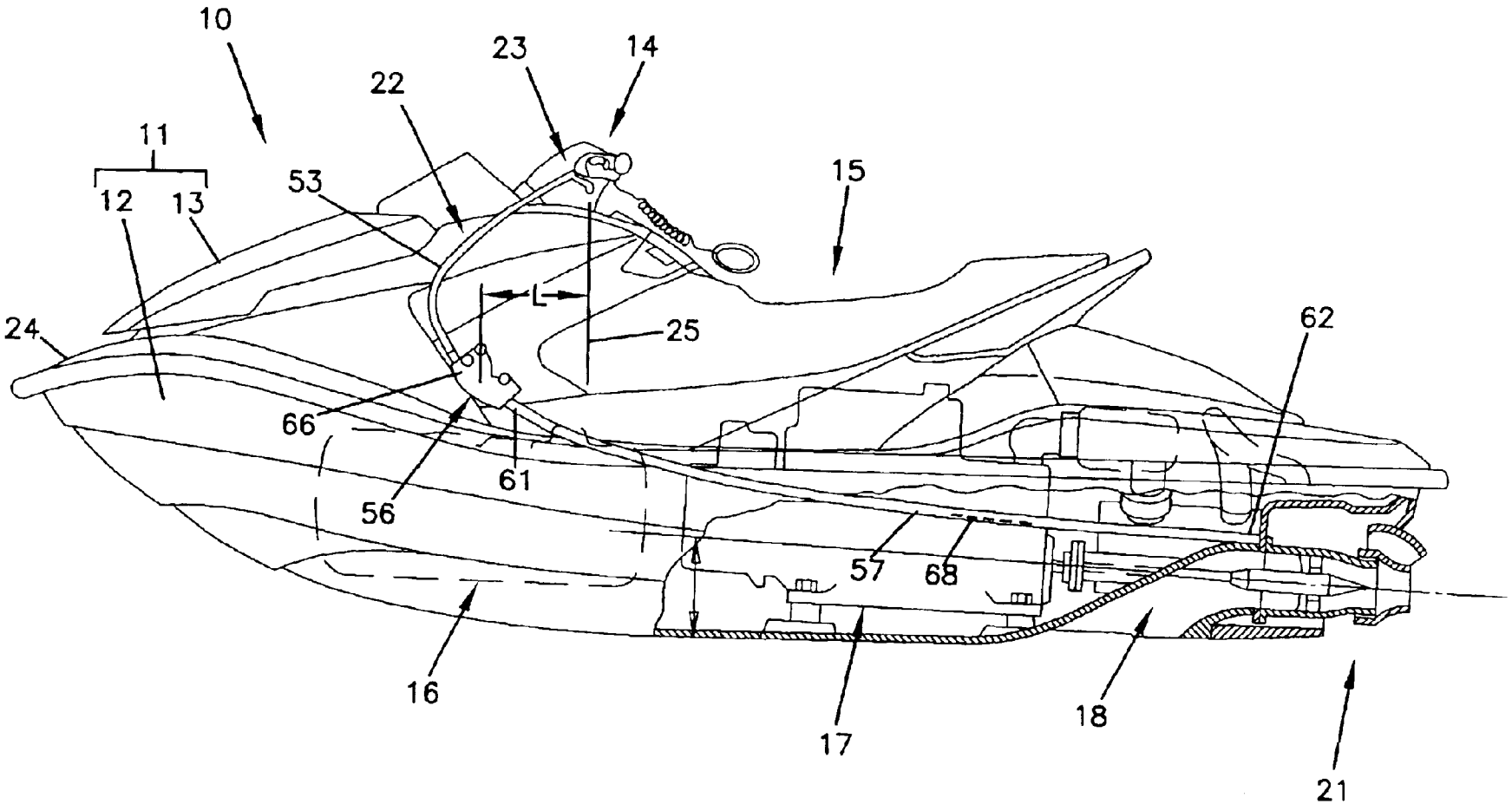
FIG. 1 is a side view of a personal watercraft using a trim operating lever device according to the present invention.

FIG. 1 is a side view of a personal watercraft using a trim operating lever device according to the present invention. The personal watercraft 10 comprises a craft body 11 composed of a hull 12 and a deck 13 joined to the upper side of the hull 12, a steering handle 14 disposed roughly at the center of the deck 13, a seat 15 provided on the rear side of the steering handle 14 and mounted on the deck 13, a fuel tank 16 and an engine 17 mounted on the center of the hull 12, a water jet propeller 18 connected to the engine 17, a steering nozzle 21 as a nozzle provided on the rear side of the water jet propeller 18, a trim operating wire 22 connected to the steering nozzle 21, and a trim operating lever device 23 provided additionally to the steering handle 14 for connection of the trim operating wire 22. Symbol 24 denotes a bow, and 25 denotes an axis located directly under the steering handle 14.

The water jet propeller 18 ejects jet water.

Figure 2:
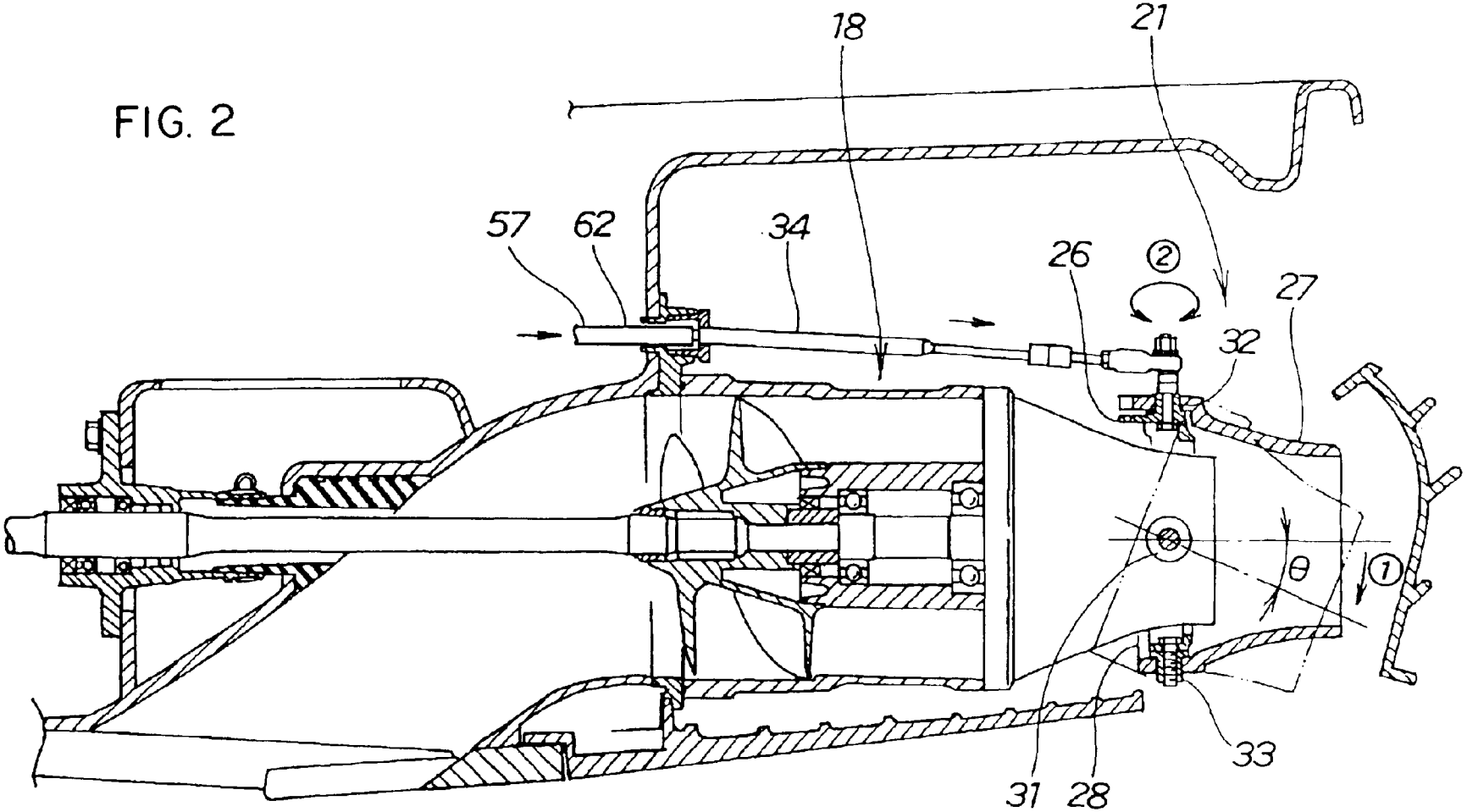
FIG. 2 is a sectional view of a steering nozzle according to the present invention.

FIG. 2 is a sectional view of the steering nozzle according to the present invention, and shows the condition where the steering nozzle 21 is directed in a first ordinary direction.

The steering nozzle 21 comprises a ring member 26 mounted onto the water jet propeller 18 so as to be oscillatable (rotatable) in the downward or vertical direction (the direction of arrow ①), and a nozzle main body 27 mounted onto the ring member 26 so as to be oscillatable in the left-right direction (the directions of arrows ②), and has the function of adjusting the jet direction of jet water.

The ring member 26 has a structure in which first receiving portions 31 are provided on the left and right sides (the front and back sides of the figure) of the ring main body 28 so as to be in connection with the water jet propeller 18, and second receiving portions 32 and 33 are provided on the upper and lower sides so as to be in connection with the nozzle main body 27. Symbol 34 denotes a connection member between push wire 57 and the second receiving portion 32, and θ denotes the trim swing angle at the time when the nozzle main body 27 is swung downwards from the first ordinary direction together with the ring member 26.

Figure 3:
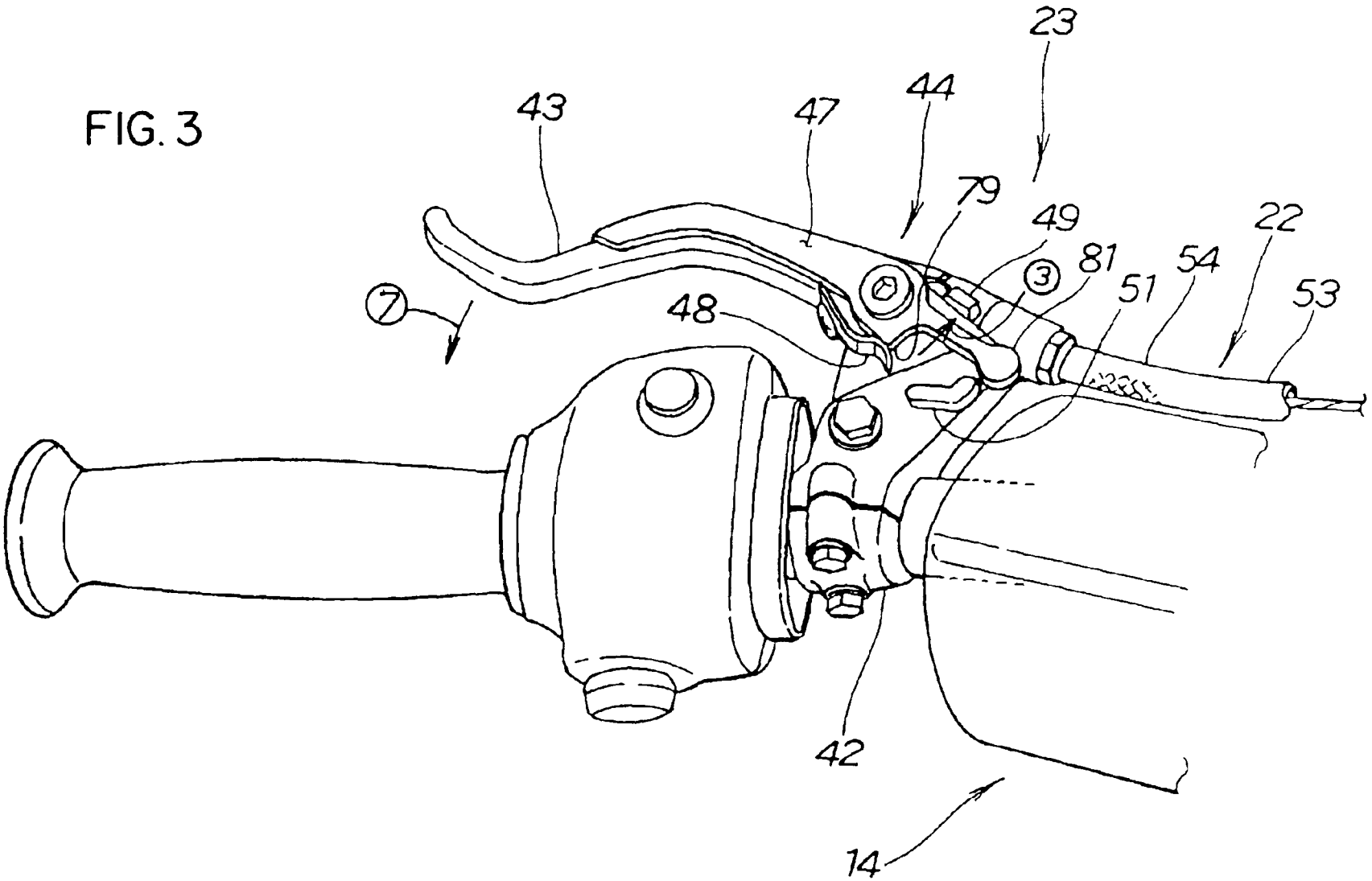
FIG. 3 is a perspective view of a trim operating lever device according to the present invention.

FIG. 3 is a perspective view of the trim operating lever device according to the present invention, and shows the condition where the trim operating lever device 23 is not being operated. The ring member 26 (see FIG. 2) and the nozzle main body 27 (see FIG. 2) of the water jet propeller with the trim operating wire 22 connected thereto are directed in the first ordinary direction indicated by the solid line.

The trim operating lever device 23 is comprised of a support member 42 attached to the steering handle 14, a trim lever main body 43 as a trim operating lever oscillatably mounted onto the support member 42, and a lever lock means 44 for locking the trim lever main body 43.

The lever lock means 44 is for locking the trim lever main body 43 in a specific grip position, and is comprised of a lock lever 47 oscillatably mounted onto the trim lever main body 43, a spring plate 48 fixed to the trim lever main body 43 so as to latch the lock lever 47 therewith, an origin stopper 49 formed on the trim lever main body 43, and an latch projected portion 51 formed on the support member 42.

Figure 4:
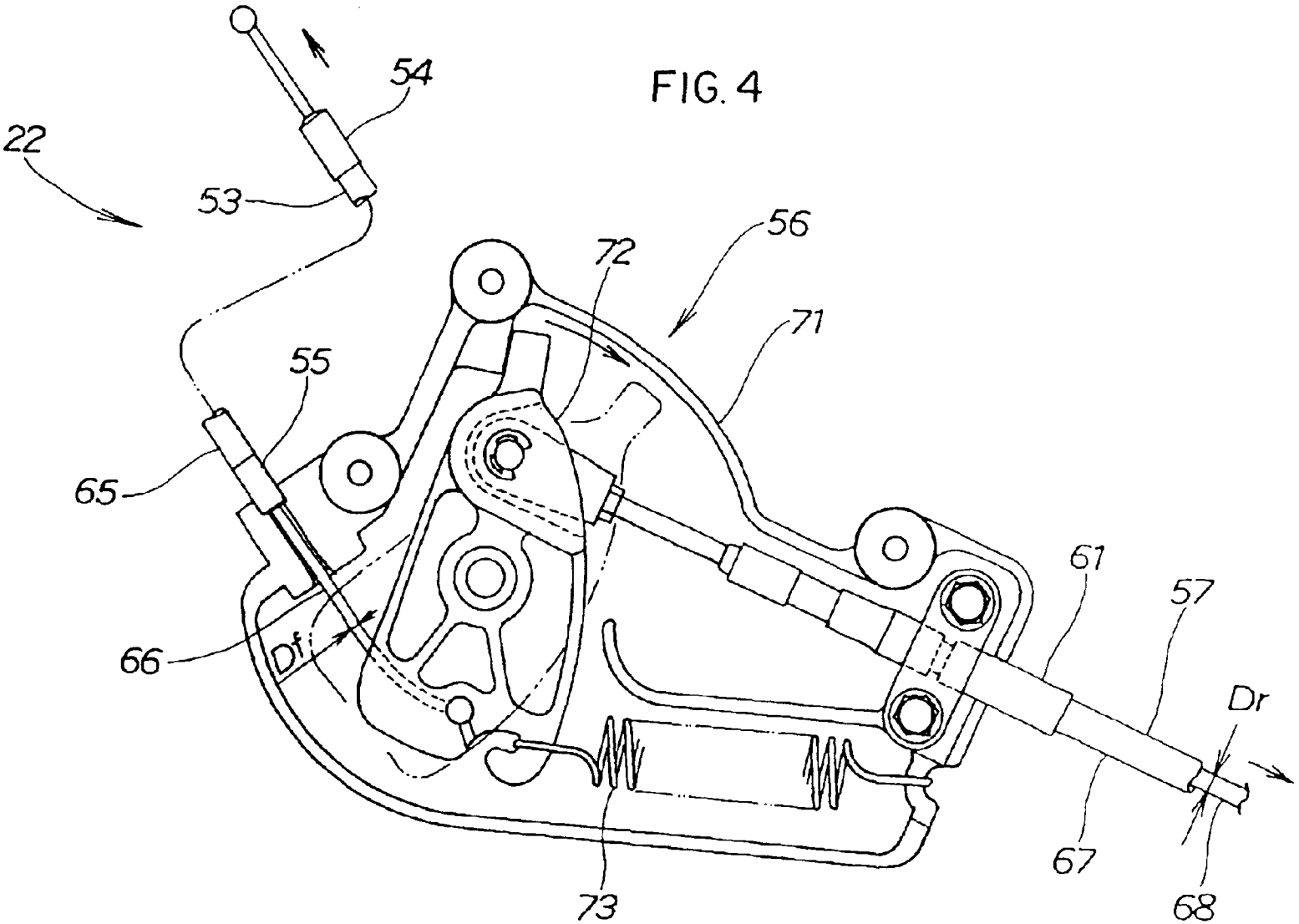
FIG. 4 is a side view of a trim operating wire according to the present invention.

FIG. 4 is a side view of the trip operating wire according to the present invention. The trip operating wire 22 has a structure in which one end 54 of the pull wire 53 which is thin and highly flexible is connected to the trim operating lever device 23 (see FIG. 3), the other end 55 of the pull wire 53 is connected to one end 61 of a push wire 57 which is thick and poorly flexible through a push-pull converter 56, and the other end 62 (see FIG. 2) of the push wire 57 is connected to the steering nozzle 21 (see FIG. 2) at the nozzle, and has the function of transmitting a force for operating the steering nozzle.

The pull wire 53 is comprised of a wire cable outer 65 and an inner wire 66. The diameter of the inner wire 66 has been set to be Df.

As the material of the inner wire 66, for example, stainless steel is used.

The push wire 57 is comprised of a wire cable outer 67 and an inner wire 68. The diameter of the inner wire 68 has been set to be Dr. The diameter Dr satisfies the relation Dr>Df.

As the material of the inner wire 68, for example, stainless steel is used.

The push-pull converter 56 has a structure in which a conversion link lever 72 is oscillatably mounted in a box 71, a tension spring 73 is hooked on the conversion link lever 72, the inner wire 66 of the pull wire 53 is connected to one end of the conversion link lever 72, and the inner wire 68 of the push wire 57 is connected to the other end of the conversion link lever 72, whereby a pulling force of the pull wire 53 is converted into a pushing force acting on the push wire 57. Incidentally, the wire cable outer 65 of the pull wire 53 is fixed to one side of the box 71, whereas the wire cable outer 67 of the push wire 57 is connected to the other side of the box 71, and the respective inner wires 66 and 68 are slid, within the respective cable outers.

As shown in FIG. 1, the push-pull converter 56 is disposed in the craft body on the bow 24 side of the axis 25 located directly under the steering handle 14 of the personal watercraft 10, at a position spaced from the axis 25 by a distance L. However, the position of arrangement of the push-pull converter 56 may also be directly under the steering handle 14, namely, on the axis 25.

Figure 5:
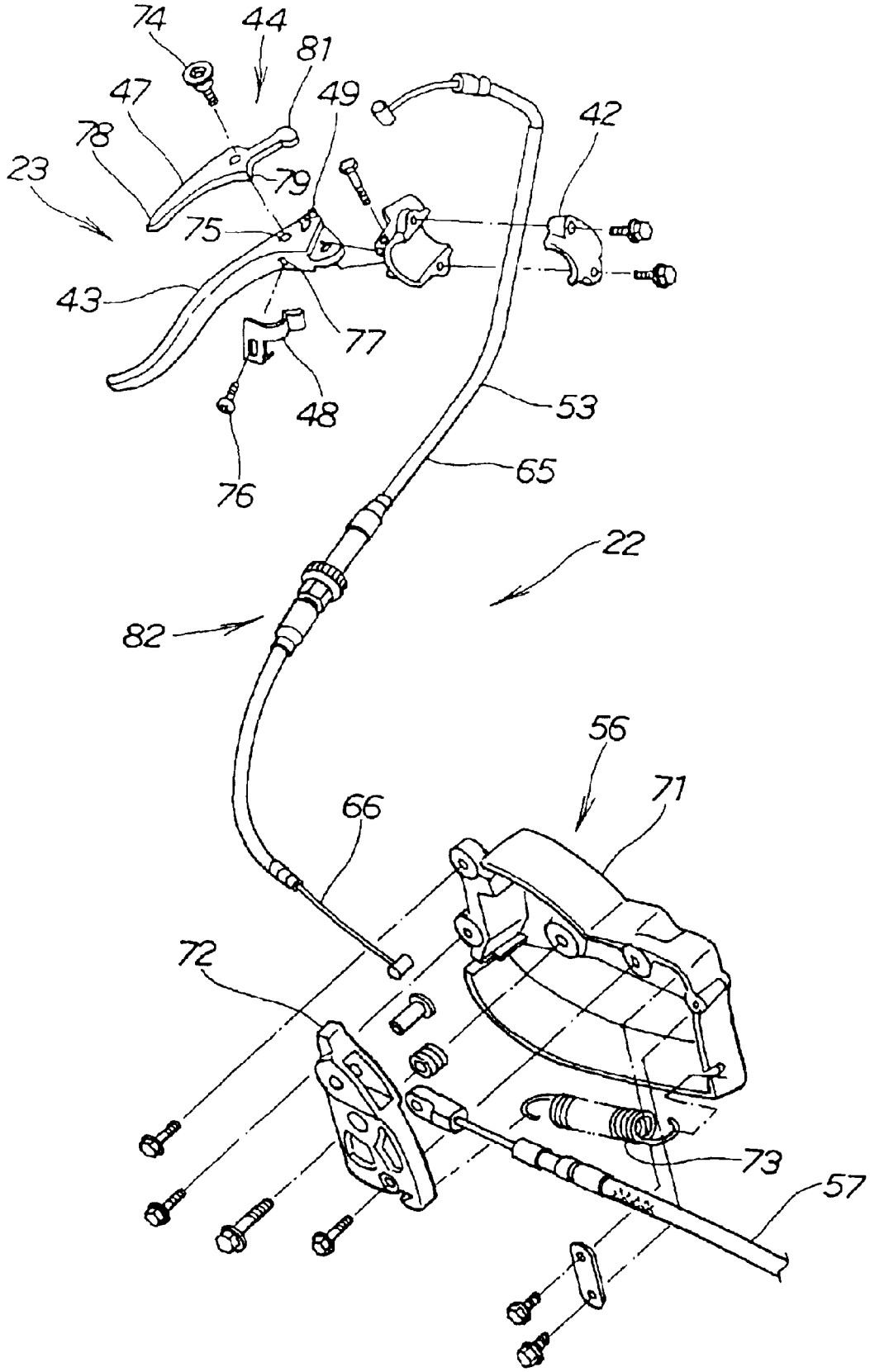
FIG. 5 is an exploded view of the trim operating lever device and the trim operating wire according to the present invention.

FIG. 5 is an exploded view of the trim operating lever device and the trim operating wire according to the present invention, and shows the support member 42 of the trim operating lever device 23, and the trim lever main body 43 oscillatably mounted onto the support member 42, and also shows the lock lever 47, the spring plate 48, and the origin stopper 49 formed on the trim lever main body 43, of the lever lock means 44.

The trim lever main body 43 is provided with a female screw 75 for a small screw 74 for mounting the lock lever 47, and is provided with a female screw 77 for a small screw 76 for mounting the spring plate 48.

The lock lever 47 is provided on its one side with a finger hook portion 78 for hooking of a finger, is provided at its center with a projected portion 79, and is provided on its other side with a latch end portion 81 to be latched on the latch projected portion 51 (see FIG. 3).

FIG. 5 further shows the pull wire 53 of the trim operating wire 22, the push-pull converter 56 (the box 71, the conversion link lever 72, and the tension spring 73), the push wire 57, and an elongation adjusting means 82 provided at the center of the pull wire 53.

Figure 6:
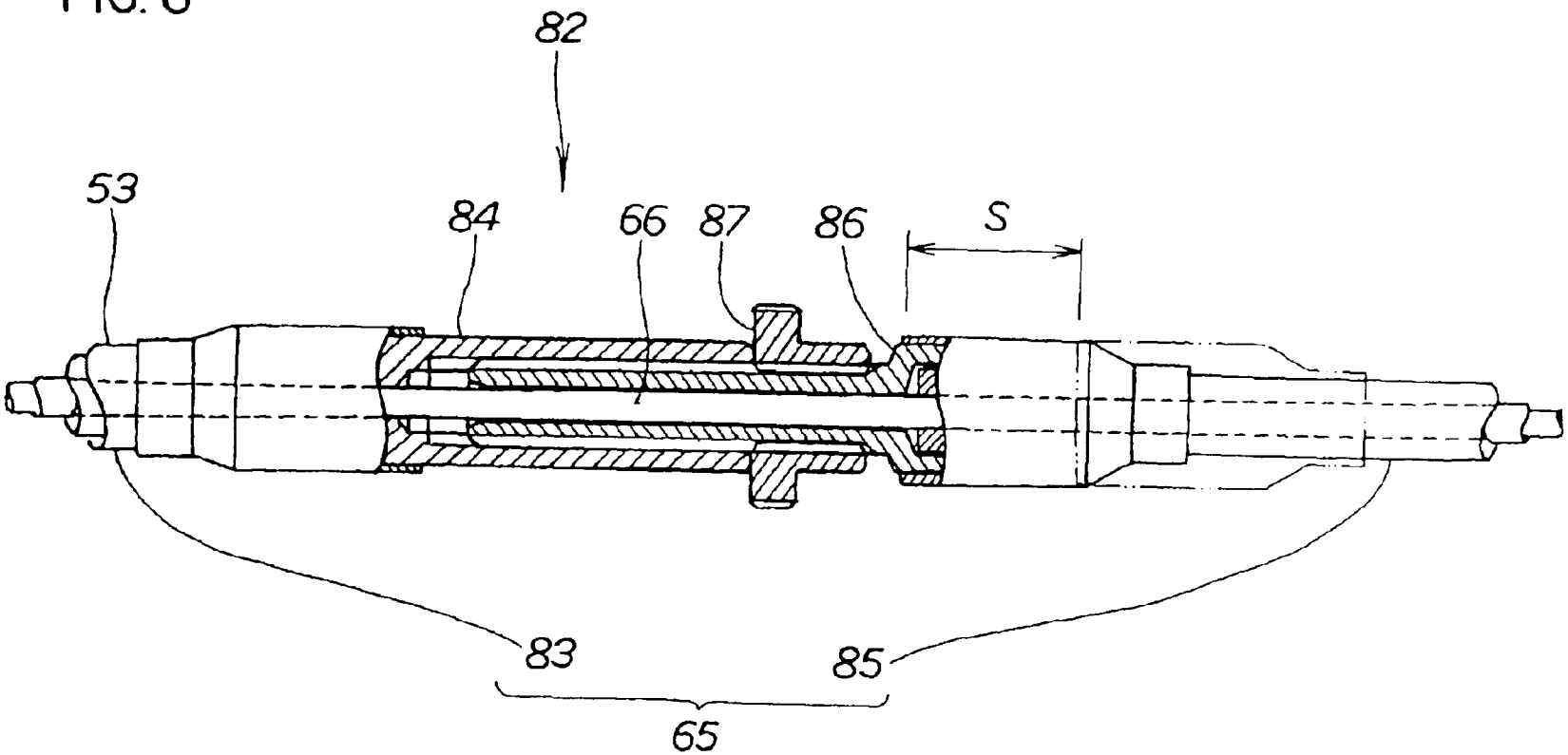
FIG. 6 is a sectional view of an elongation adjusting means according to the present invention.

FIG. 6 is a sectional view of the elongation adjusting means according to the present invention. The elongation adjusting means 82 has a structure in which the wire cable outer 65 of the pull wire 53 is divided into two portions, an adjusting nut 84 is attached to a first wire cable outer 83 located on the side of the trim operating lever device 23 (see FIG. 5), an adjusting bolt 86 is attached to a second wire cable outer 85 located on the side of the push-pull converter 56 (see FIG. 5), and a jam nut 87 is used. Symbol S denotes an adjustment margin.

Functions of the trim operating lever device for the personal watercraft as described above will be described below.

In the trim operating lever device 23 which is not being used as shown in FIG. 3, the lock lever 47 is in an unlocking condition, and the spring plate 48 presses a projected portion 79 of the lock lever 47 as indicated by arrow ③, whereby the lock lever 47 is stopped by the origin stopper 49, and maintains the condition of integral close contact.

From the position of the trim lever main body 43 shown in FIG. 3, gripping of the trim lever main body 43 by a left-hand finger as indicated by arrow ⑦ is started.

Figure 7:
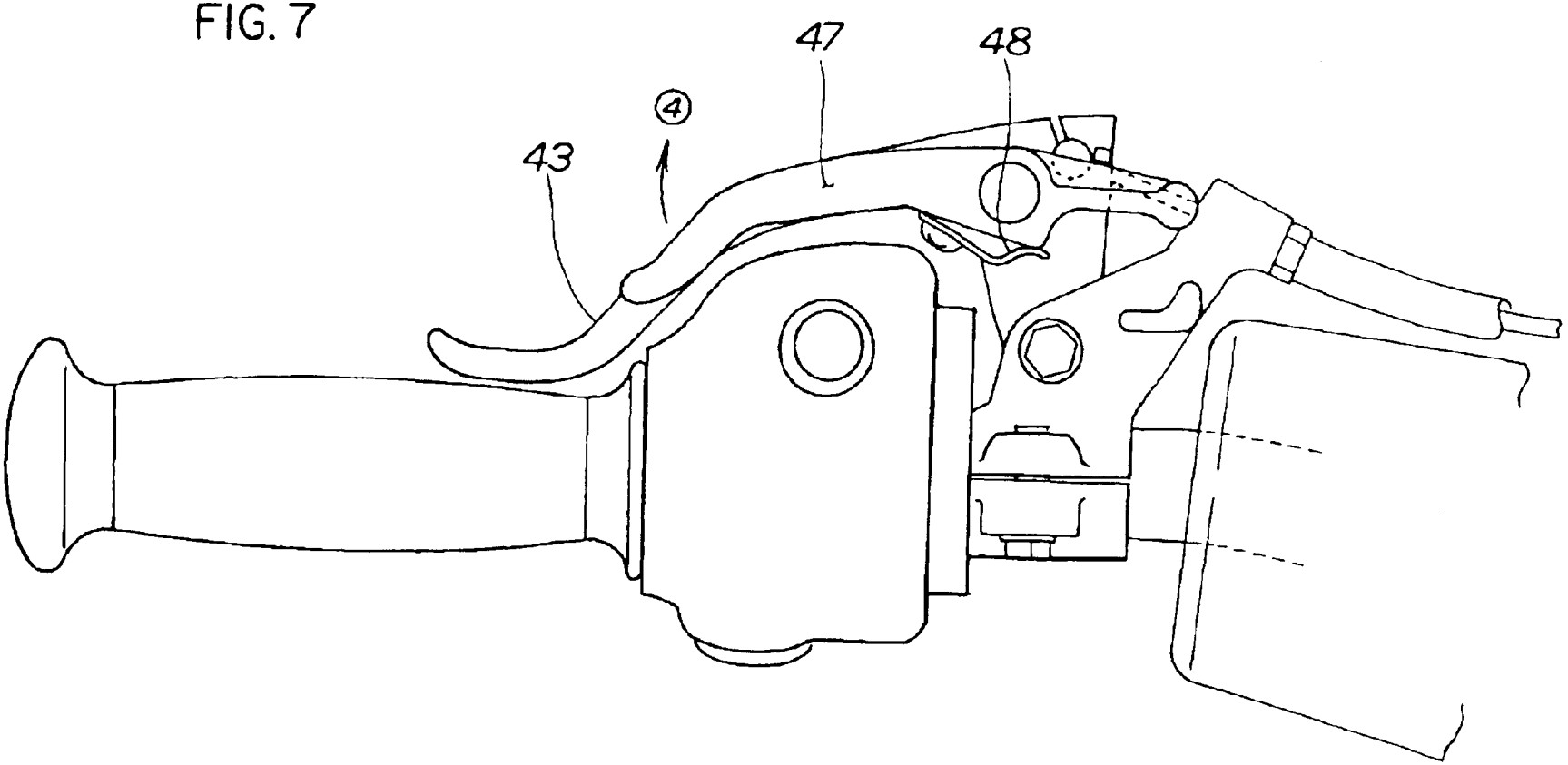
FIG. 7 is a first function view of the trim operating lever device according to the present invention.

FIG. 7 is a first function view of the trim operating lever device according to the present invention.

The trim lever main body 43 is gripped, and when the trim lever main body 43 has reached a specific grip position (the condition shown in FIG. 7), the lock lever 47 is pushed out with a finger as indicated by arrow ④ and against the spring plate 48.

Figure 8:
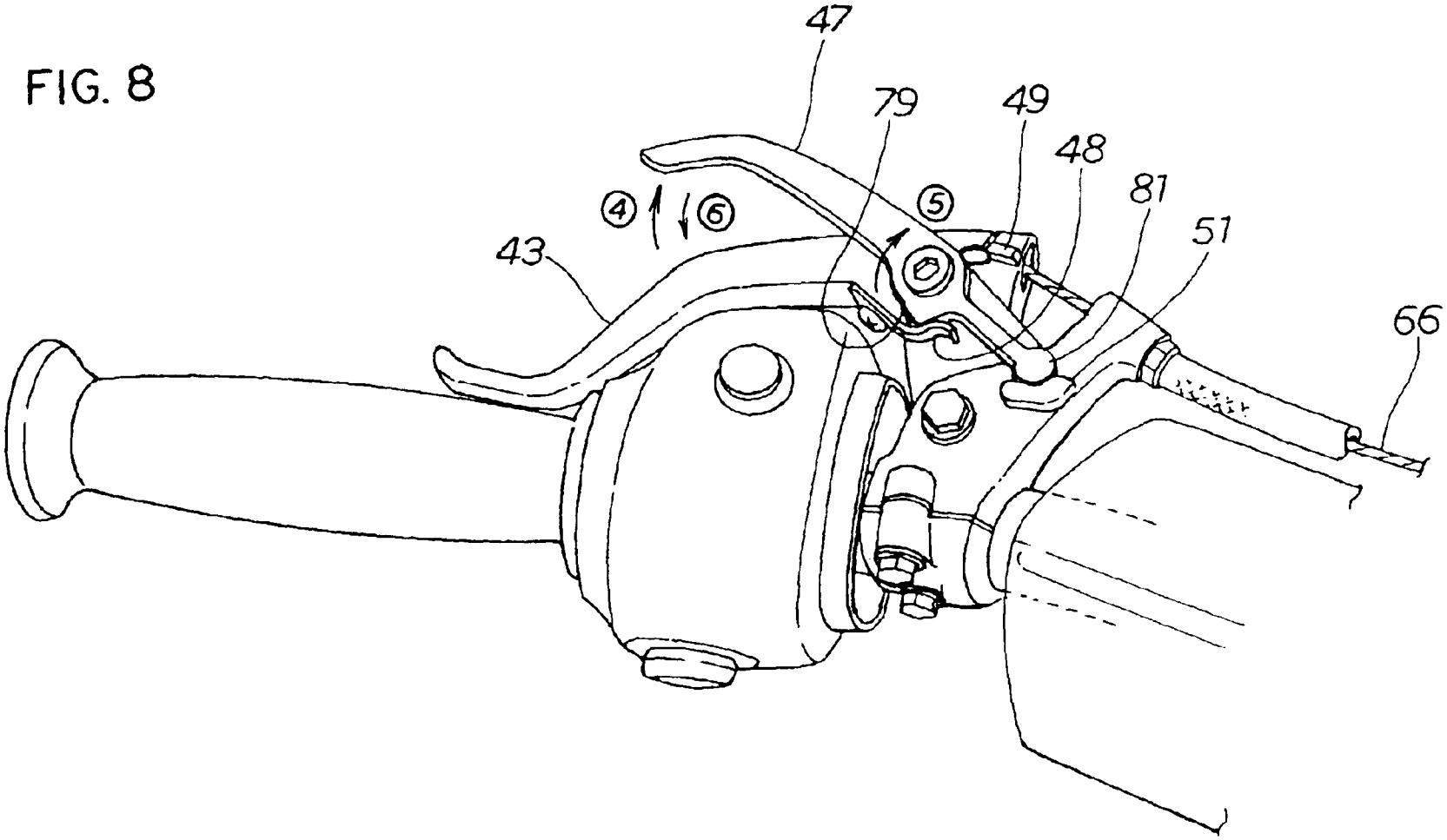
FIG. 8 is a second function view of the trim operating lever device according to the present invention.
Figure 9:
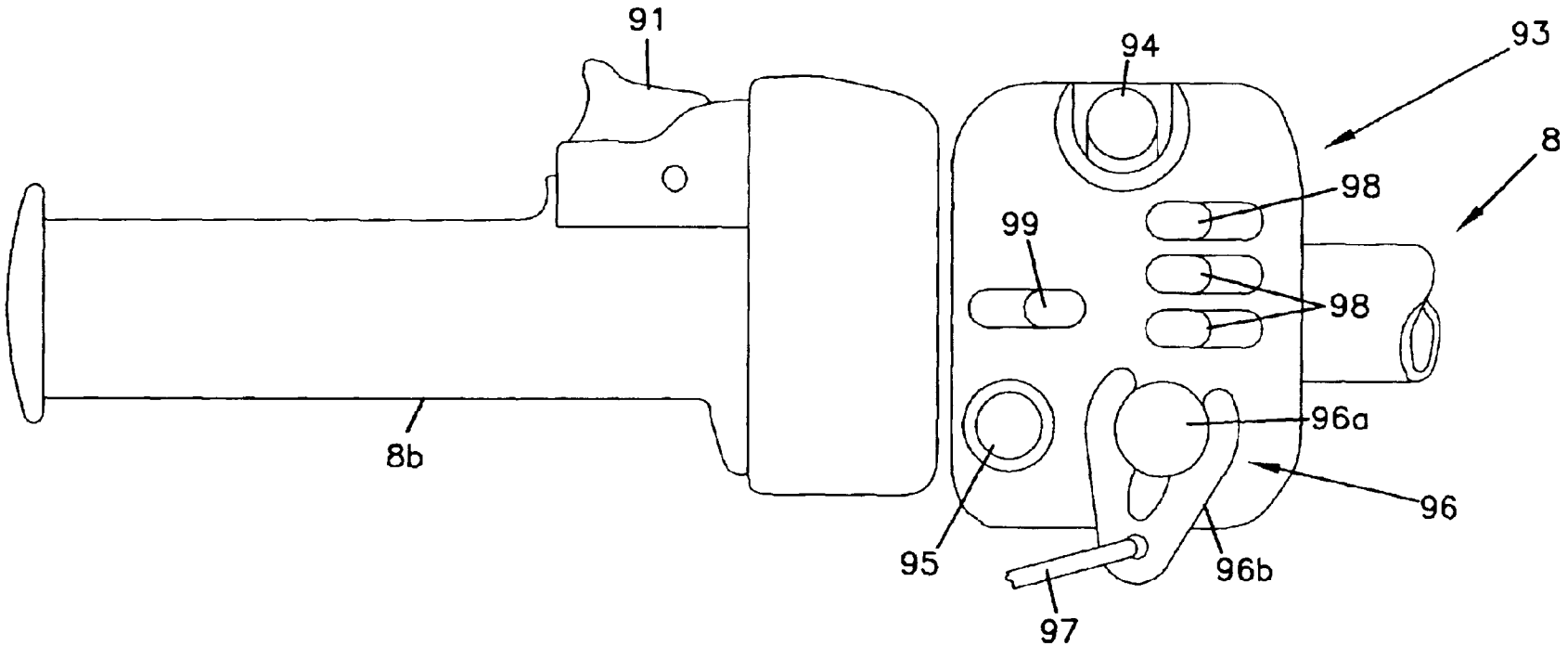
FIG. 9 is an illustration of a conventional left-side grip portion.

FIG. 8 is a second function view of the trim operating lever device according to the present invention.

With the lock lever 47 pushed out as indicated by arrow ⑥, a latch end portion 81 of the lock lever 47 makes contact with a latch projected portion 51, and the spring force of the spring plate 48 acts on the projected portion 79 at the center of the lock lever 47 as indicated by arrow ⑤, so that the lock lever 47 is stopped even when the finger is released from the lock lever 47, and the trim lever main body 43 can be locked in the specific grip position. Therefore, the number of operations by the left hand necessary for swinging the steering nozzle 21 (see FIG. 2) is only two.

In the case of unlocking, the lock lever 47 is gripped. Specifically, the lock lever 47 is gripped with a finger as indicated by arrow ⑥, upon which the latch end portion 81 of the lock lever 47 is disengaged from the latch projected portion 51, so that the unlocking can be achieved.

Furthermore, the trim operating lever makes it possible to enlarge the operating force, so that the nozzle can be swung quickly.

The construction of the lever lock means 44 for locking the trim lever main body 43 of the trim operating lever device 23 shown in the embodiment of the present invention is merely an example, and other mechanisms may be used for locking. For example, a pin inserting/drawing-out mechanism or a hook engaging/disengaging mechanism may be used, or a lock member may be inserted between the support member 42 and the trim lever main body 43.

We claim:

1. A trim operating lever device for a personal watercraft comprising:

a nozzle for adjusting the direction of jet water, a steering handle, a trim operating lever attached to the steering handle, and a lever lock structure attached to the trim operating lever, wherein the nozzle rotates vertically as the trim operating lever oscillates, wherein the lever lock structure locks the trim operating lever in a fully gripped position against the steering handle.

2. A trim operating lever device for a personal watercraft comprising:

a nozzle for adjusting the direction of jet water, a steering handle, a trim operating lever attached to the steering handle, and a lever lock structure including a lock lever, a spring plate, and an origin stopper attached to the trim operating lever, wherein the nozzle rotates vertically as the trim operating lever oscillates, wherein the lever lock structure locks the trim operating lever in a specific position.

3. The trim operating lever device for a personal watercraft of claim 2, wherein the lock lever comprises:

a finger hook portion, a projected portion, and a latch end portion, wherein the spring plate contacts the projected portion of the lock lever.

4. The trim operating lever device for a personal watercraft of claim 3, wherein the lock lever oscillates between a locked position and an unlocked position.

5. The trim operating lever device for a personal watercraft of claim 4, wherein the latch end portion of the lock lever contacts a latch projected portion attached to the steering handle when the lock lever is in the locked position.

6. A trim operating lever device for a personal watercraft comprising:

a jet propeller for ejecting jet water, a nozzle capable of adjusting the direction of the jet water, the nozzle being operably connected to the jet propeller, a steering handle, and means attached to the steering handle for controlling the nozzle, said controlling means including a trim operating lever attached to the steering handle, and means for locking the trim operating lever in a specific position, said locking means including a lock lever a spring plate, and an origin stopper, wherein the nozzle rotates vertically as the trim operating lever oscillates.

7. The trim operating lever device of claim 6, wherein the means attached to the steering handle for controlling the nozzle comprises means for adjusting the direction of the jet water with only two hand operations.

* * * * *